US006511306B2

(12) United States Patent
Pierrat

(10) Patent No.: US 6,511,306 B2
(45) Date of Patent: Jan. 28, 2003

(54) ZERO LEAKAGE VALVELESS POSITIVE FLUID DISPLACEMENT DEVICE

(75) Inventor: Michel A. Pierrat, Boulder, CO (US)

(73) Assignee: Encynova International, Inc., Broomfield, CO (US)

( * ) Notice: Subject to any disclaimer, the term of this patent is extended or adjusted under 35 U.S.C. 154(b) by 65 days.

(21) Appl. No.: 09/860,112

(22) Filed: May 17, 2001

(65) Prior Publication Data

US 2001/0042436 A1 Nov. 22, 2001

Related U.S. Application Data

(60) Provisional application No. 60/204,951, filed on May 17, 2000.

(51) Int. Cl.[7] ..... F04B 7/04; F04B 19/02; F01B 9/00

(52) U.S. Cl. ..... 417/491; 417/466; 417/534; 91/498; 92/140; 74/50

(58) Field of Search ..... 417/491, 466, 417/534; 91/498, 491; 92/140; 74/50

(56) References Cited

U.S. PATENT DOCUMENTS

| | | | | | |
|---|---|---|---|---|---|
| 1,349,667 | A | | 8/1920 | Gogolinski | 417/466 |
| 2,981,201 | A | | 4/1961 | Holdener | 417/466 |
| 3,310,000 | A | * | 3/1967 | Martin | 417/420 |
| 3,884,125 | A | | 5/1975 | Massie | 417/274 |
| 4,011,842 | A | * | 3/1977 | Davies et al. | 123/61 R |
| 4,072,210 | A | * | 2/1978 | Chien | 184/5 |
| 4,443,163 | A | | 4/1984 | Gaither | 417/466 |
| 4,625,683 | A | | 12/1986 | Bonfilio | 123/44 R |
| 4,641,611 | A | | 2/1987 | Stiller et al. | 123/54.2 |
| 4,682,569 | A | | 7/1987 | Stiller et al. | 123/54.2 |
| 4,907,950 | A | | 3/1990 | Pierrat | 417/271 |
| 5,004,404 | A | | 4/1991 | Pierrat | 417/273 |
| 5,046,459 | A | | 9/1991 | Stiller et al. | 123/54.2 |
| 5,114,321 | A | | 5/1992 | Milburn et al. | 417/467 |
| 5,180,292 | A | | 1/1993 | Abousabha | 417/273 |
| 5,259,256 | A | * | 11/1993 | Brackett | 123/55.3 |
| 6,162,030 | A | | 12/2000 | Pierrat | 417/497 |
| 6,283,723 | B1 | * | 9/2001 | Milburn et al. | 417/273 |

* cited by examiner

*Primary Examiner*—Charles G. Freay
*Assistant Examiner*—Michael K. Gray
(74) *Attorney, Agent, or Firm*—Charles E. Rohrer

(57) ABSTRACT

A Positive Fluid Displacement Device (PFDD) with single piece double-ended pistons connected to a crankpin for circular motion. Pistons are nested together to maintain all pistons in the same plane perpendicular to the axis of the crankshaft. Cylinders are driven in a reciprocating fashion by the pistons and are held loosely in a cylinder carriage along its axis with radial sealing engagement therebetween. Pliable members mount port plates within a housing such that there is no direct contact therebetween or with a two-layer manifold. A flat surface of the port plate is urged against the cylinder head by a pliable member which exerts a force on the center of the port plate. Grooves in the first layer of the manifold are sealed by the second layer to form fluid passageways. The cylinder head is guided in housing grooves with a pliable member. A sealing lip is integral with a piston head.

43 Claims, 10 Drawing Sheets

ZERO LEAKAGE VALVELESS POSITIVE FLUID DISPLACEMENT DEVICE

This application claims the benefit of U.S. Provisional Patent Application No. 60/204,951 filed May 17, 2000. This invention relates to improvements to the positive fluid displacement device (PFDD) with a removable fluid displacement module (FDM) which is the subject of U.S. Pat. No. 6,162,030 issued Dec. 19, 2000, incorporated herein by reference.

FIELD OF THE INVENTION

This invention relates to positive fluid displacement devices and more particularly to devices of the piston type for precision fluid delivery.

BACKGROUND OF THE INVENTION

U.S. Pat. No. 6,162,030 describes a Positive Fluid Displacement Device (PFDD) which is the basis of the current invention. The object of the current invention is to improve the design of the patented device. The improved design described herein provides better performance, includes a broader range of applications, improves manufacturability, broadens tolerances, eliminates parts, eases assembly and lowers cost. However, the principles of operation of the PFDD are unchanged and since those principles are fully described in FIGS. 1A–1D of the referenced patent, they are not repeated herein.

The design has been improved by replacing separate metal parts with single parts using metal or plastic material. The coupling of some components has been modified to allow significantly greater variation in tolerances without reduction in accuracy of fluid delivery and performance of the PFDD. Pliable members are used to position parts with respect to each other for quieter operation, easier assembly and broadening of the tolerances. The configuration of the seals has been modified to eliminate metal parts and to allow the use of different sealing materials in order to meet chemical compatibility requirements with a minimum of changes.

The use of glass and ceramic material as wetted parts in the device requires careful mounting since those parts cannot be made to the same degree of accuracy as can plastic and metal parts. Therefore, a design which allows significant tolerance in the dimensions of the wetted parts eliminates secondary machining or grinding, thus producing a lower cost device.

Design improvements in the manifold permit variation in the internal configuration of the manifold passageways to meet different customer requirements, without change in the basic PFDD configuration. Improved mounts for motor connection permit different types of motors to be used, and provides improved rigidity in a minimum amount of space. The inclusion of an optional gearbox permits the use of a smaller motor by increasing the torque available from the motor.

SUMMARY OF THE INVENTION

One aspect of this invention involves the replacement of the multi-part four-piston assembly of the Fluid Displacement Module (FDM) described in the referenced patent with two single parts, each acting as a double-headed piston. Each part is such that it can nest into another identical part, thus providing four pistons in the same plane but oriented approximately 90° apart. The two double-headed pistons are rotatably connected together in a plane perpendicular to the axis of the crankshaft. They are mounted concentrically around the crankpin, so the 90° separation of the pistons is not established by the pistons, but rather by the position of two cylinder carriages. The position of the carriages is defined by grooves in the housing of the PFDD.

Each piston head also acts as a piston seal and each seal is secured directly to the end of the piston. The double-headed piston slides through the carriage for ease of assembly. Like the patented device, each one has a protrusion to fit inside the port in the cylinder head to reduce dead volume.

A second aspect of this invention involves a cushioned support for holding the port plate that floats along an axis perpendicular to the axis of the crankshaft. The port plate is captivated to the housing by pliable members such as elastomeric cords which are embedded into the housing. This allows micromotion of the port plate inside the housing, without any part of the port plate directly in contact with the housing. This eliminates rubbing of the port plate directly against the housing, and provides for wide tolerance in the machining of the housing and the port plate. It also provides a spring action on the port plate against the manifold, thus insuring good sealing contact on seals located between the manifold and port plate without preventing the port plate from floating against the cylinder head.

A third aspect of this invention also relates to cushioning the cylinder heads as they act against the manifold. The cylinder heads are slidably mounted on plastic rails that are also slidably mounted into grooves machined into the housing of the PFDD. Behind the rails, embedded inside the bottom of the grooves, is a pliable buffering member which acts as a spring pushing the cylinder heads against the manifold. The intimate and continuous contact of the cylinder heads against the manifold provides a silent operation without the need to machine the depth of the grooves and the width of the cylinder heads to high precision.

A fourth aspect of this invention is to provide controlled pressure on the port plate toward the cylinder head in order to maintain zero leakage. This is accomplished by providing a resilient urging member between the housing and the port plate to urge the port plate against the cylinder head. The urging member, may be an elastomeric material or a spring. If a spring is used, the port plates are provided with a groove on the surface opposite the surface sliding against the cylinder head. The groove captivates a metal spring that applies pressure to the center of the port plate. The length and thickness of the spring precisely controls its force against the port plate. The two opposite ends of the spring react against the internal surface of the housing. This design reduces clearance between the top of the port plate and the external surface of the housing to near zero, thus reducing overall dimensions of the housing.

A fifth aspect of this invention is to provide a cushioned mounting for essentially brittle ceramic or glass cylinders which are loosely mounted inside the cylinder head and the carriage. At the cylinder head, a compliant sealing member provides a seal between cylinder and the cylinder head that acts in a direction parallel to the sliding surface of the cylinder head, thereby avoiding pressure on the cylinder head in a direction perpendicular to the sliding surface. In that manner, distortion of the flatness of the sliding surface of the cylinder head is prevented since there is no contact pressure between the cylinder and the cylinder head, except through the sealing member. The sealing member, which may be an O-ring, also acts to center the cylinder inside the counterbore of the cylinder head. At the other end of the cylinder, a compliant washer, made of Teflon for example, is interposed between the cylinder and the carriage to prevent direct contact between the cylinder and the carriage, thereby avoiding stressing the glass or ceramic cylinder when the cylinder head is assembled to the carriage.

Additionally, the area of the end surfaces of the carriage in contact with the cylinder head are reduced by providing recesses. The reduction of the contact surface area allows them to be machined and lapped to a flatness of better than two light bands.

A sixth aspect of this invention is to provide a double-layer manifold that is fastened against the PFDD housing. A first layer of a two-layer manifold has a surface, opposite to the surface in contact with the housing, with fluid passageways grooved therein. The second layer of the two-layer manifold is pressed against the first layer and seals all the grooved passageways. Connection to the fluid supply and to devices using the PFDD is done through inlet and outlet ports on the second layer. The advantage of this design is the elimination of drilling long holes in the manifold and the use of smaller cross section passageways than can be done with a long hole design. The tightness of the fluid passageways is insured between the surfaces of the manifolds by lapping them to a flatness of better than two light bands.

A seventh aspect of this invention is to directly mount the motor to the back of the PFDD, without couplings, and to have, as an option, a torque-increasing gearbox interposed between the motor and the PFDD.

The above mentioned and other features and objects of this invention and the manner of obtaining them will become more apparent, and the invention itself will best be understood by reference to the following description of embodiments of the invention taken in conjunction with the accompanying drawing, a description of which follows.

DETAILED DESCRIPTION

Figure 1:
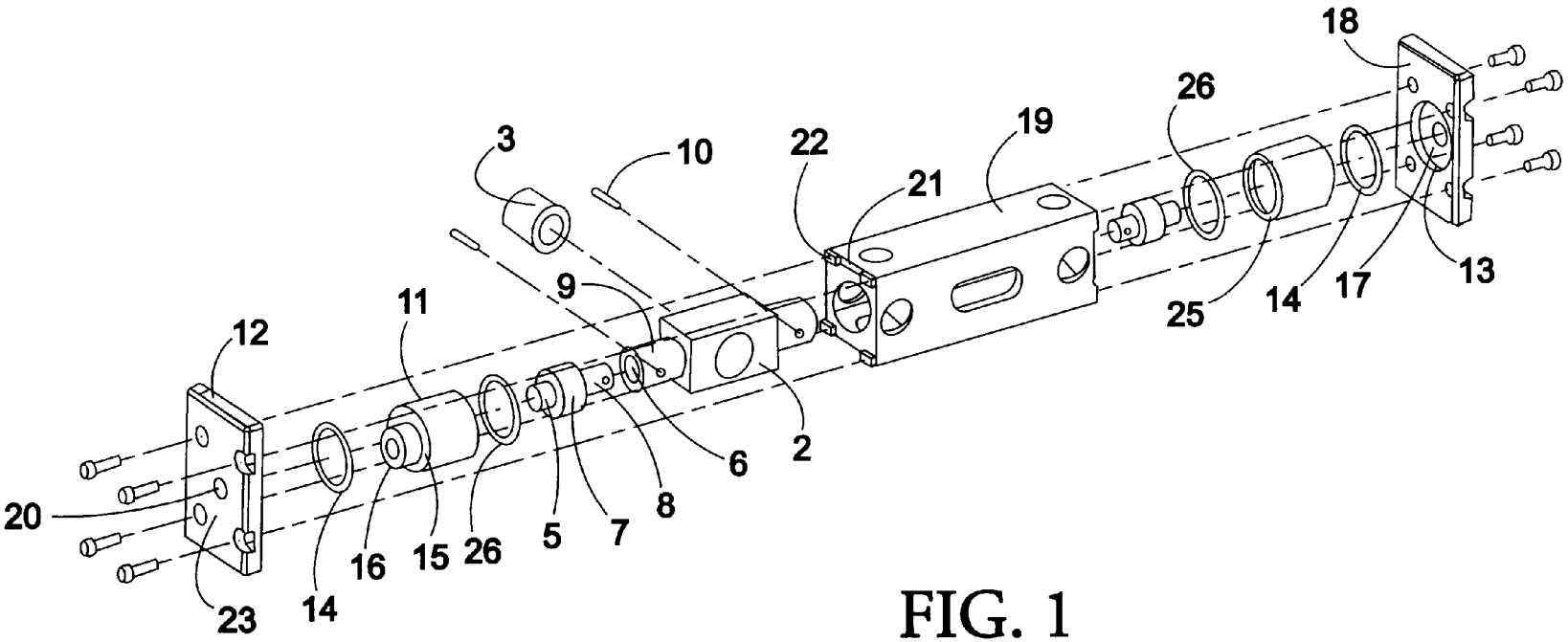
FIG. 1 is an exploded view of a two piston fluid displacement module showing a double-ended single piece piston.

When reference is made to the drawing, like numerals indicate like parts and structural features in the various figures.

FIG. 1 is an exploded view of a fluid displacement module (FDM) showing a double-ended single piece piston 2. Piston 2 has an end 9 having an opening 6 for holding a stem 8 of a single piece piston head 7. A second piston head is held in the opposite end of piston 2. In assembly, the piston heads are joined to the piston by pins 10. Each piston head 7 has a protrusion 5 for filling openings 20 in cylinder heads 12 at top dead center. Hereafter, one piston/cylinder combination with associated elements is described since each combination is identical to the other in configuration although diameter of cylinders can vary.

Figure 4:
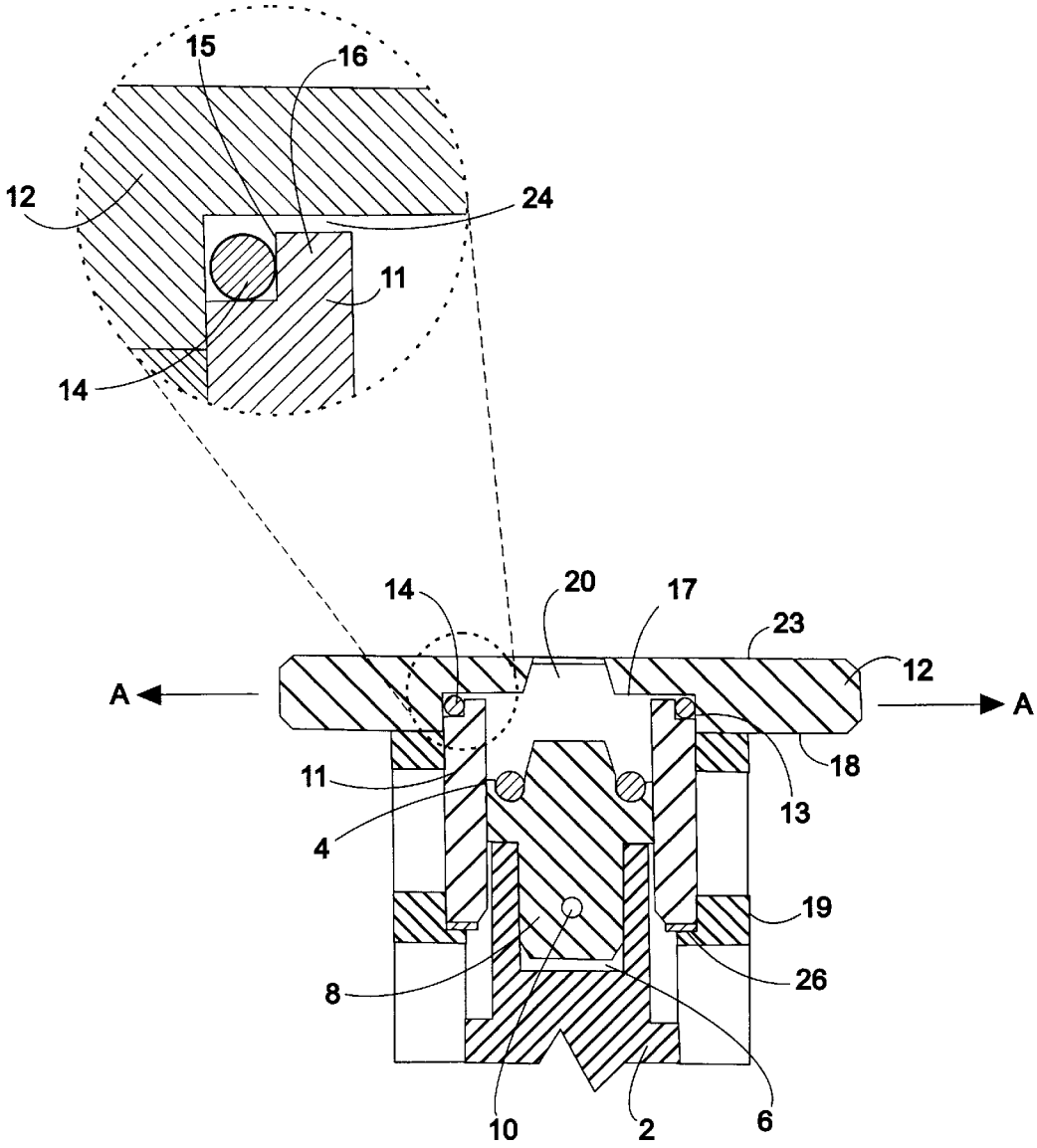
FIG. 4 is a cross-sectional view showing the seal configuration between the cylinder head and cylinder. It also shows the piston seal.

The piston and piston head assembly fits into a cylinder 11. Cylinder 11 has a groove 15 on an end 16 providing for the location of a compliant sealing member 14 such as an O-ring. The end 16 of cylinder 11 fits into counterbore 13 of cylinder head 12. In assembly with the cylinder head, the cylinder 11 is not pressed against the bottom 17 of counterbore 13 as shown in FIG. 4. In assembly, the bottom surface 25 of cylinder 11 is cushioned from contact with cylinder carriage 19 by a compliant washer 26 interposed between the two parts.

Cylinder head 12 has a sliding surface 23 which is machined and lapped for sliding against a port plate, not shown in FIG. 1. Opposite surface 23 is a surface 18 of cylinder head 12 which mates with small contact surfaces 22 on cylinder carriage 19. There are four contact surfaces 22 on each end of cylinder carriage 19 to mate with surface 18. The four small contact surfaces are provided by locating four recesses 21 in the end of cylinder carriage 19.

A crankshaft, not shown, drives piston 2 through a bearing 3.

Figure 2:
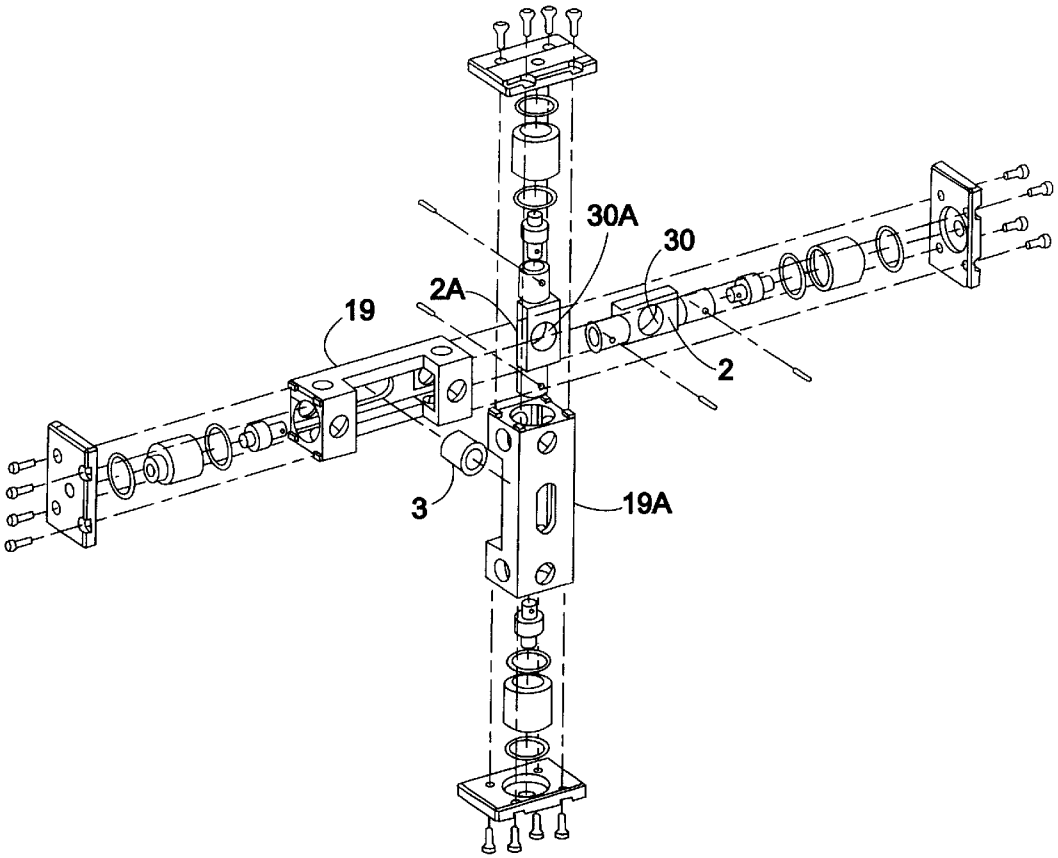
FIG. 2 is an exploded view of a four piston fluid displacement device showing two fluid displacement modules each with a double-ended single piece piston which are designed to nest together in the PFDD.

FIG. 2 is an exploded view of two fluid displacement modules showing how one can be nested in assembly with another around the crankshaft bearing 3. Cylinder carriage 19 and cylinder carriage 19A carry pistons 2 and 2A, respectively, with bearing 3 passing through the openings 30 and 30A in the pistons.

Figure 3:
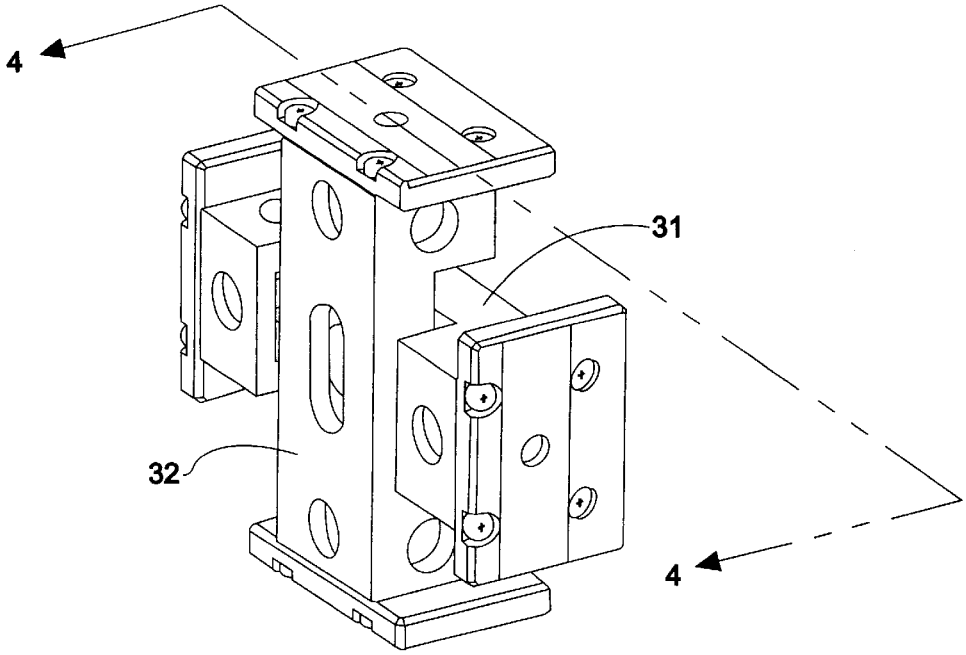
FIG. 3 shows two fluid displacement modules nested together in assembly.

FIG. 3 shows two fluid displacement modules 31 and 32 in assembly. When in assembly the device is a four-piston fluid displacement device and the two modules 31 and 32 are then sometimes referred to as one fluid displacement module.

FIG. 4 is a cross-sectional view taken along line 4—4 of FIG. 3. It shows the cylinder, cylinder head, piston head and piston in assembly. Cylinder head 12 has an opening 20 which is emptied of fluid by protrusion 5 on piston head 7 at top dead center of piston travel. In assembly, cylinder 11 is spaced from cylinder head 12 by clearance space 24. The bottom end of cylinder 11 is located on a compliant washer 26 which is interposed between cylinder 11 and cylinder carriage 19 and is intended to reduce clearance space 24 to near zero. Cylinder 11 is shown assembled within counterbore 13 with compliant sealing member 14 located between the cylinder and the cylinder head to provide sealing engagement therebetween. Piston 2 is assembled with piston head 7 through pin 10. A seal between piston head 7 and cylinder 11 is provided by a sealing lip 4 which is integral with piston head 7. Lip 4 is backed by an elastomeric element 27 which may be an O-ring.

Figure 5:
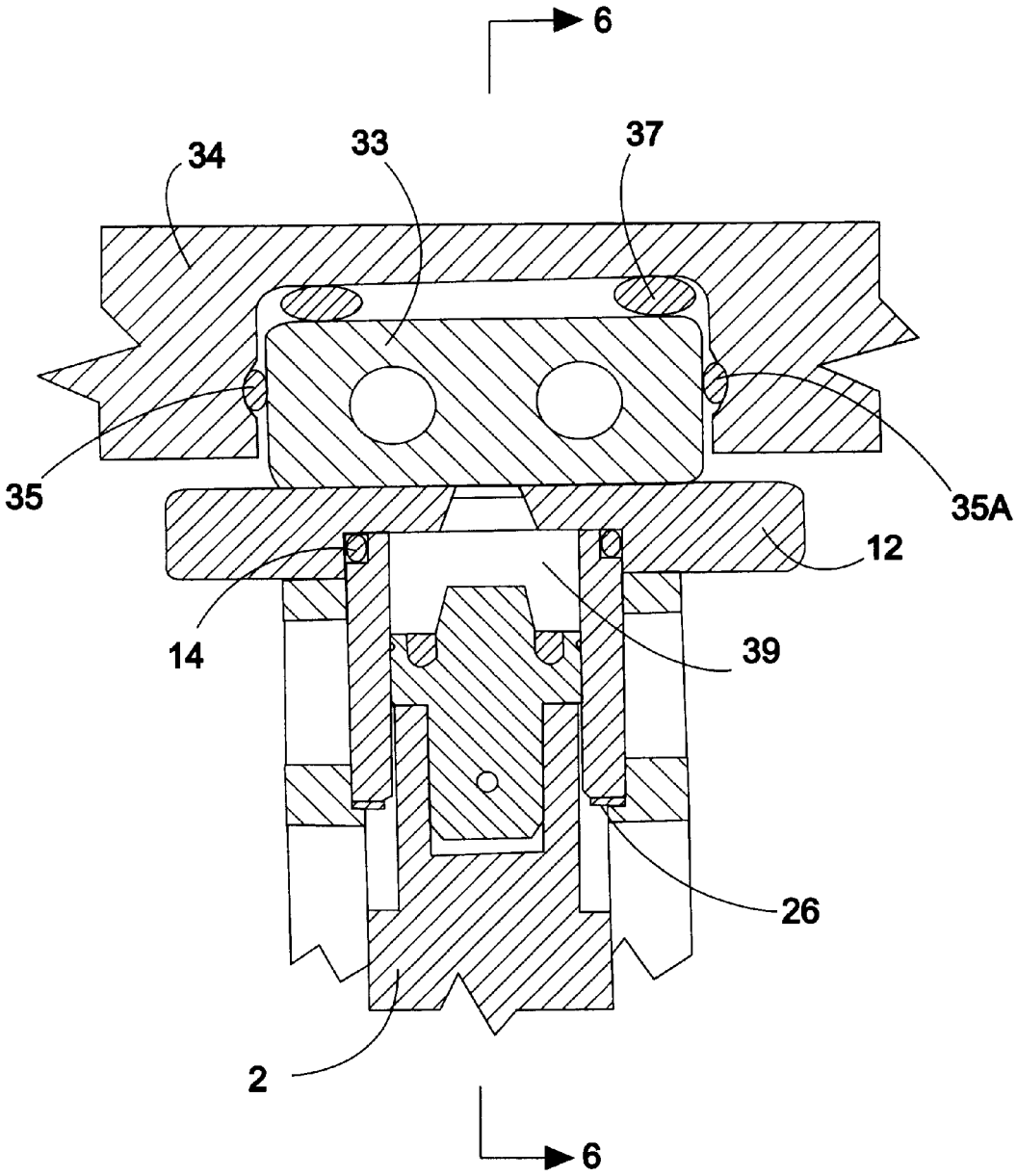
FIG. 5 is a cross-sectional view showing the captivation of the port plate inside the PFDD housing in a plane perpendicular to the axis of the crankshaft.

FIG. 5 is a partial cross-sectional view showing the assembly of floating port plate 33 with the cylinder/piston combination. An urging member 37, which may be of elastomeric material, is interposed between the top surface of port plate 33 and the housing 34 of the PFDD. Pliable members 35 and 35A, which may be made of elastomeric material, are interposed between the left and right surfaces of port plate 33 and the housing 34.

FIG. 5 shows displacement chamber 39 within cylinder 11. Chamber 39 receives and discharges fluid through opening 20 in cylinder head 12.

Figure 6:
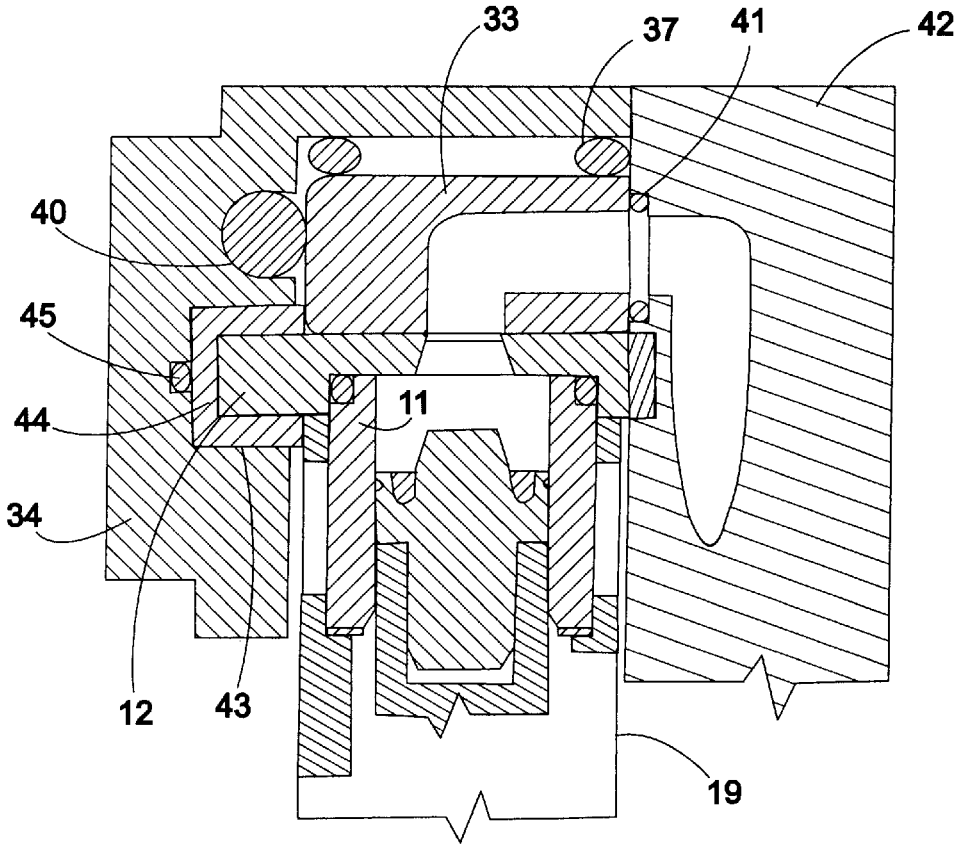
FIG. 6 is a cross-sectional view showing the captivation of the port plate inside the housing of the PFDD in a plane parallel to the axis of the crankshaft.

FIG. 6 also shows the captivation of the port plate 33 within the housing 34 and shows another pliable buffering member 40 interposed between the back side of port plate 33 and the housing 34. Together FIGS. 5 and 6 show that the port plate 33 does not come into direct mechanical contact with the housing 34.

Pliable seal 41, which may be an O-ring, provides a seal between manifold 42 and port plate 33. Rail 44 is located within a groove 43 in the housing 34 and provides support for the cylinder head 12 which slides within the rail 44. A resilient member 45 is located between rail 44 and housing 34 providing compliance to the arrangement of rail and housing.

Figure 7:
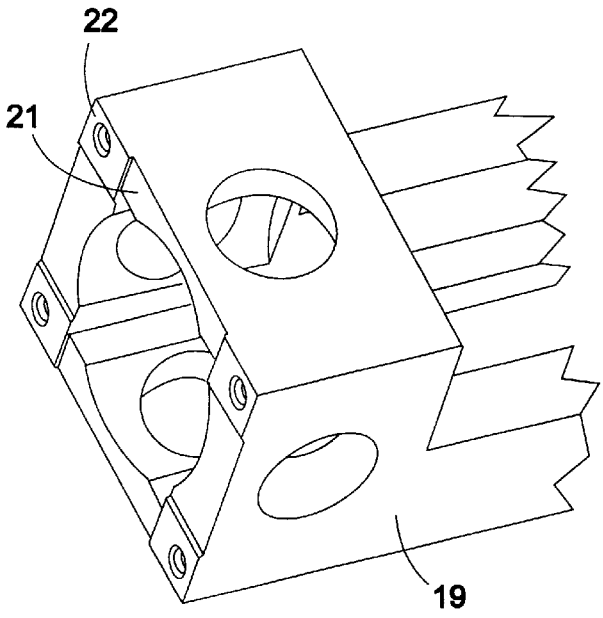
FIG. 7 is a partial view of the cylinder carriage showing four contact surfaces which are machined and lapped for contact with the cylinder head.

FIG. 7 is a partial perspective view of cylinder carriage 19 and shows four recesses 21 in the end surface of cylinder 19. Recesses 21 provide four small contact surfaces 22 which are machined and lapped to close tolerance for connection to cylinder head 12. These four surfaces as well as surfaces 18 and 23 of cylinder head 12 (FIG. 4) are machined and lapped to a flatness of better than two light bands.

Figure 8:
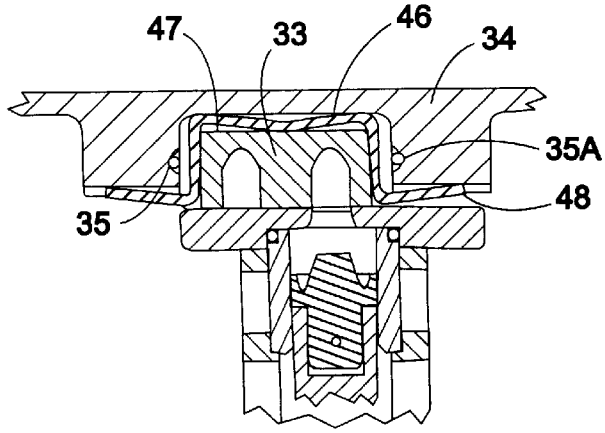
FIG. 8 is a cross-sectional view showing a metal spring located in a groove in a floating port plate to react with the housing and provide force on the floating port plate.

FIG. 8 is a partial cross-sectional view showing the pliable member 37 as a spring 46 interposed between the housing 34 and port plate 33. Spring 46 is located in a groove 47 in port plate 33 with the ends 48 of spring 46 bearing against the housing 34. The spring applies pressure in the center of the port plate achieving superior control with a reduction in the clearance between the port plate and the housing compared to the elastomeric embodiment of FIG. 5.

Figure 9:
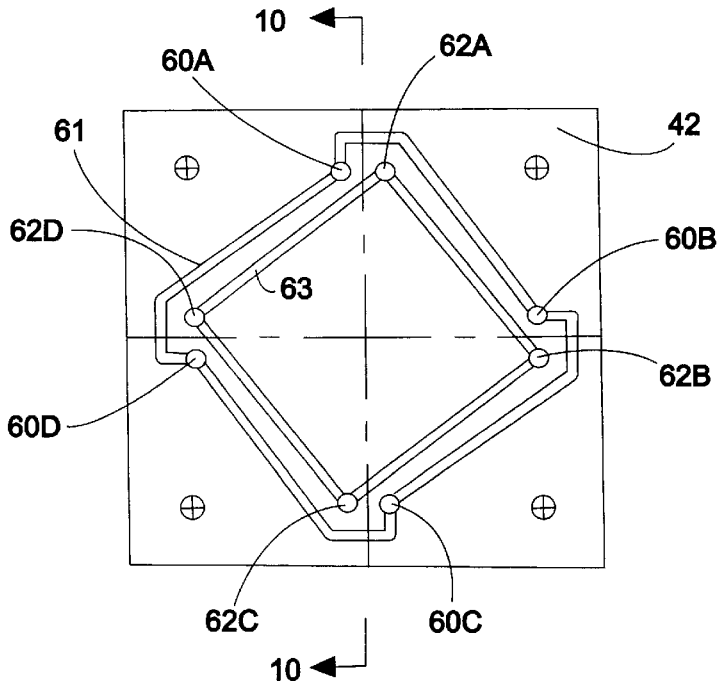
FIG. 9 shows one piece of a two piece manifold with grooves and ports machined into the piece shown.
Figure 10:
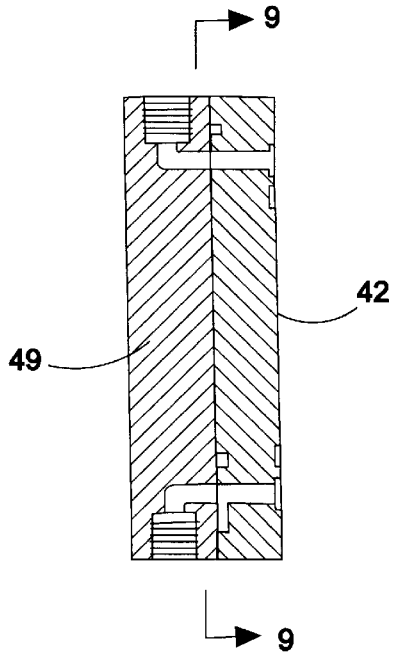
FIG. 10 is a cross-sectional view of the two piece manifold.

FIGS. 9 and 10 show a two-layer manifold with a first layer 42 directly adjacent to the port plate 33 and a second layer 49 on the opposite side of layer 42. Layer 49 has inlet and outlet ports 50 and 51 to supply fluid to the PFDD and an outlet connection to components outside the PFDD. FIG. 9 shows layer 42 with grooves 61 and 63 cut into the surface of layer 42 extending from and to ports 60 and 62. Grooves 61 and 63 are machined into the surface of layer 42 and are sealed by layer 49 when the manifold is assembled to create passageways for fluid to communicate with ports 60 and 62. Ports 60A and 62A may be the inlet and outlet ports in communication with corresponding ports in the port plate of a first piston/cylinder assembly. Ports 60B and 62B are for a second piston/cylinder assembly, ports 60C and 62C are for a third such assembly, and ports 60D and 62D are for a fourth such assembly.

Figure 11:
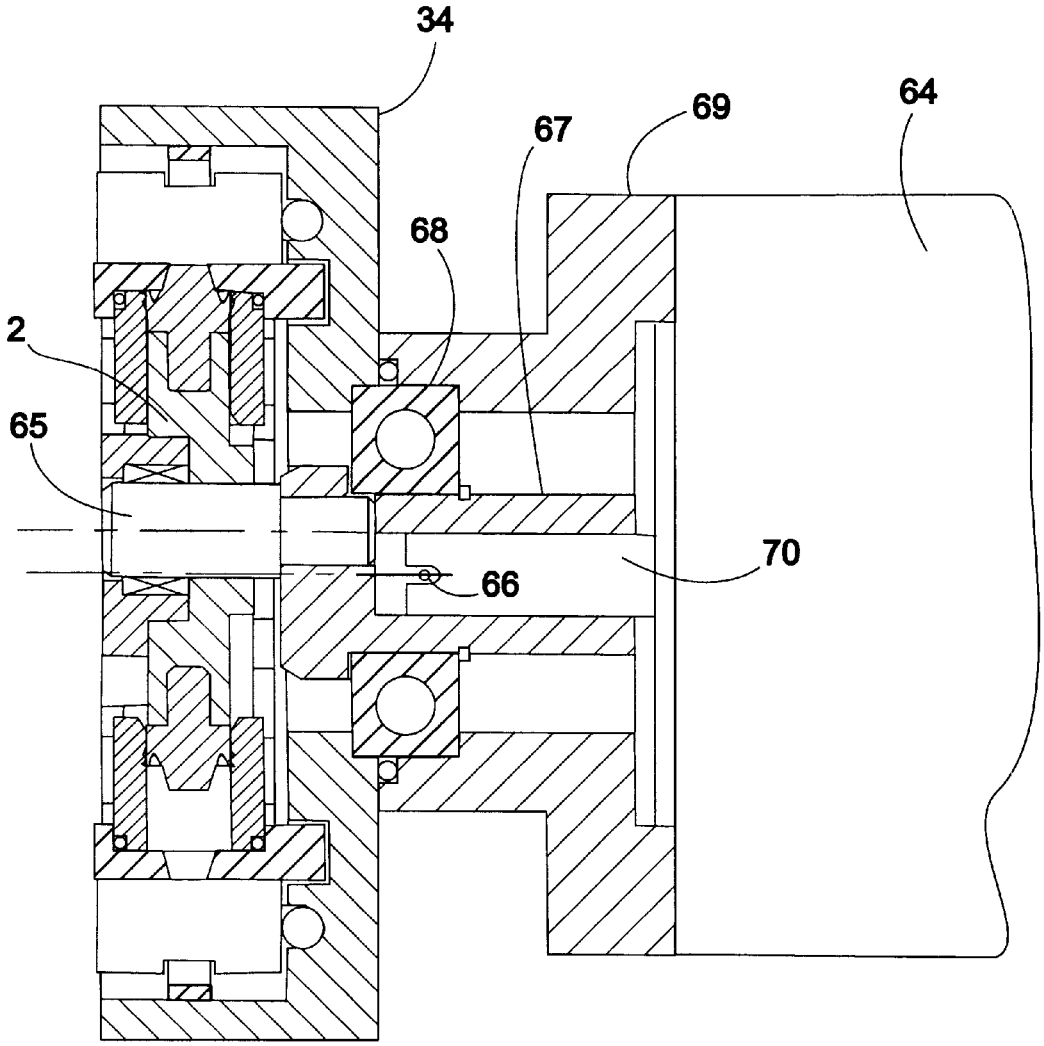
FIG. 11 is a cross-sectional view of the PFDD showing a motor mounted to the PFDD.

FIG. 11 is a cross-sectional view of the PFDD in assembly with motor 64. Drive shaft 70 is directly connected to crankshaft 67 through a pin 66. Bearing 68 carries the crankshaft 67 and is interposed between adapter 69 and the housing 34 of the PFDD. Crankpin 65 is connected with a centerline offset from the centerline of crankshaft 67 in order to provide an orbital motion to piston 2 mounted on the crankpin. Diameter of piston movement is equal to twice the eccentricity of crankpin 65. This design achieves a small PFDD/motor package and provides direct connection of the motor driveshaft to the PFDD crankshaft.

Figure 12:
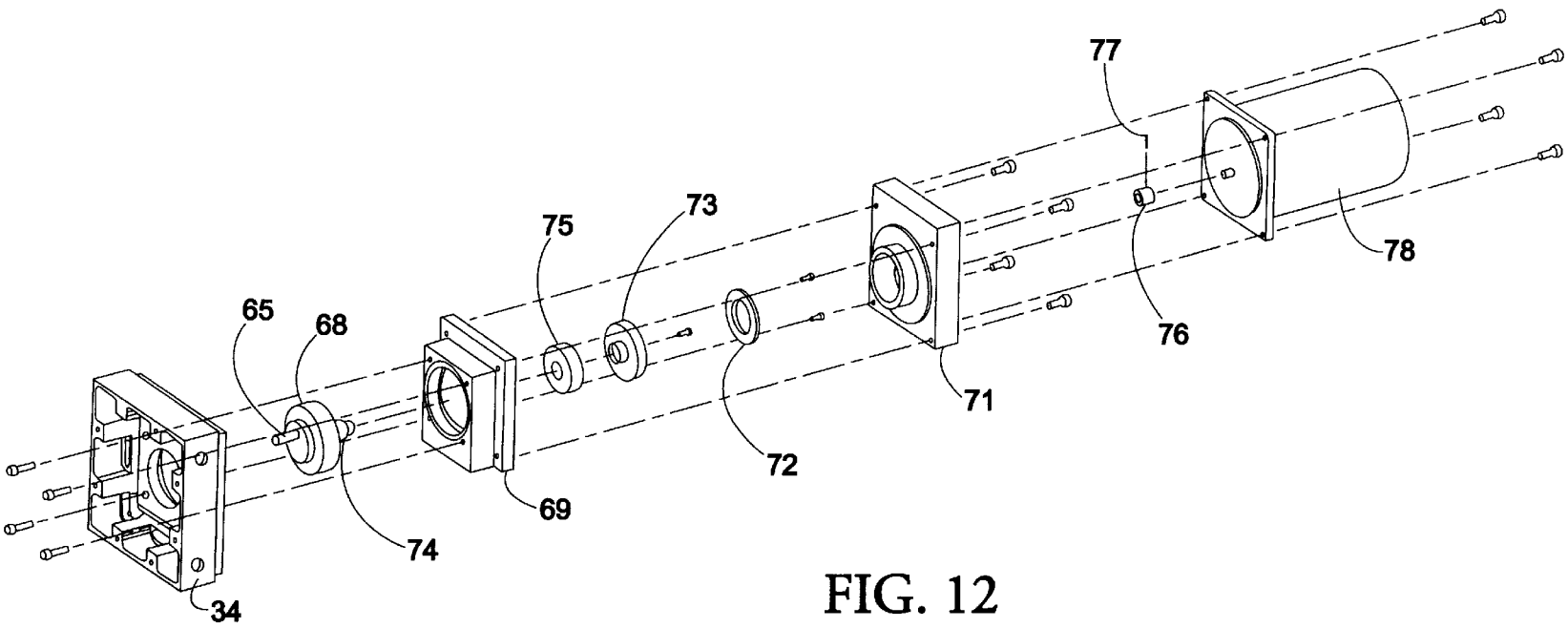
FIG. 12 is an exploded view of a motor mounting with a torque increaser.

FIG. 12 is an exploded view showing another motor 78 with its shaft modified to accommodate a pinion 76. The pinion meshes with gear 72 to drive crankshaft 74 through disk 73 and achieve torque requirements. The pinion 76 is secured with the pin 77 to the motor driveshaft. Disk 73 is secured to crankshaft 74. Location of the disk 73 is accurately controlled and provides precise meshing of the pinion and the ring gear. The motor is bolted to the adapter 69 via an eccentric ring 71 that provides support for the bearing 75.

In operation of the PFDD, and with respect to FIG. 4, fluid enters the displacement chamber 39 through opening 20 in the cylinder head and fills the displacement chamber. The fluid contacts piston seal 4 but never comes into contact with the piston 2. The 5 fluid is also dispelled from the displacement chamber through opening 20 and on through the port plate 33 and the passageways and ports in the manifold to using devices exterior to the PFDD.

Note that the cylinder 11 fits inside the cylinder head 12 into the counterbore 13 with a seal which is a compliant sealing member 14. The end 16 of cylinder 11 does not come into pressurized mechanical contact with the bottom 17 of the counterbore 13 and therefore axial forces are not placed on the cylinder 15 (nor on the cylinder head.) The sealing pressure of member 14, which may be an O-ring, is exerted radially in a plane parallel to the large surface 18 of the cylinder head. Sealing pressure from member 14 is along line A—A as shown in FIG. 4. The presence of the small clearance space 24 prevents any possibility of axial pressure on the cylinder head or the cylinder when the two are assembled. Note that the other end 25 of cylinder 11 is restrained on the cylinder carriage by a washer 26 made out of a semi-compliant material such as teflon. As a result the cylinder, which is often made of glass or ceramic material, is not stressed under axial forces when the PFDD is assembled and in use. Also, the arrangement avoids pressure on the cylinder head in a direction perpendicular to sliding surface 23 and therefore distortions of the surface sliding against the port plate are prevented.

FIG. 2, an exploded view of fluid displacement modules, shows the construction which enables a nesting of the cylinder carriages within each other. It shows two double-ended pistons which are connected together around a bearing sleeve 3. Since the pistons are connected around a bearing sleeve, the 90° angle between the two double-ended pistons is not defined by the pistons but rather by the position of the cylinder heads sliding within the rails 44. Rails 44 are in turn held inside grooves 43 in the PFDD housing. As a consequence, no binding occurs and precision in establishing the angularity of the pistons is not required. Note that the carriages 19 and 19A are of the same basic construction with the center of each carriage cut or milled out to allow the nesting of the carriages into each other. In that manner the axis of the two double-ended pistons are in the same plane, perpendicular to the axis of the crankshaft. FIG. 3 shows the two double-ended pistons and the carriages nested together to form a four piston fluid displacement module.

As mentioned above, FIGS. 5 and 6 show that the port plate 33 does not come into direct mechanical contact with housing 34. The port plate is urged against the cylinder head by pliable member 37 which may be, for example, an elastomer or a spring, and is held away from housing 34 by pliable members 35, 35A, 37 and 40. Forces exerted on the port plate by resilient members 40 are balanced by the pliable seal 41 located between the manifold 42 and the port plate. The port plate is never in direct mechanical contact with either the housing 34 or the manifold 42, thus avoiding any abrasion which would be caused by micromotion of the hard material port plate (ceramic, sapphire, hardened steel, etc.) with the housing or manifold. The only direct contact of surfaces on the port plate with another part is the surface-to-surface contact with surface 23 of cylinder head 12. Because of manufacturing tolerance, the cylinder head sliding in the rails 44 of the housing is not kept in a constant geometric location. Therefore, the surface of port plate 33 in contact with surface 23 of cylinder head 12, which surface must always be in intimate contact with the cylinder head 12, must be allowed to float and follow the geometric location of the cylinder head. As a result, a constant micromotion of the port plate results and can be very destructive to other surfaces of the port plate if they are in direct mechanical contact with the housing or manifold. The use of pliable members between those surfaces allows micromotion of the port plate to follow the cylinder head with no damage.

FIG. 6 shows a groove 43 cut into the housing 34. The purpose of the groove is to hold rail 34 along which the cylinder head slides. A resilient member 45 is located at the bottom of groove 43 and urges the cylinder head toward the manifold 42. This arrangement eliminates clearance between the two large longitudinal sliding surfaces of the cylinder head, that is, surfaces which slide against the rail and the manifold. This assures a quiet operation and eliminates the requirement of precision manufacturing tolerances on the cylinder head and in the depth of the groove 43.

FIGS. 9 and 10 show the two-layer manifold which has grooves cut into the surface of the first manifold layer in order to provide communication between the ports 60 and 62. The grooves may be cut in the same manufacturing setup in which the surface of manifold layer 42 is machined. The grooves are sealed by a second manifold layer 49 to provide passageways for conducting fluid through the manifold. The surfaces between the two layers are lapped to a flatness of better than two light bands to insure leak tightness without the need for using a gasket. Inlet and outlet ports on the second manifold layer 49 are connected to the passageways in the first manifold layer 42. For applications where very low flow is required and minimum volume in the pump is a requirement, the passageways can be very small yet accessible and easy to clean.

While the invention has been shown and described with reference to preferred embodiments thereof, it should be understood that changes in the form and details of the invention may be made therein without departing from the spirit and scope of the invention.

What is claimed is:

1. A positive fluid displacement device (PFDD) for delivering a fluid comprising a housing for said device;

a crankshaft mounted within said housing, said crankshaft for coupling to the driveshaft of a motor;

a crankpin connected to said crankshaft to provide an orbital movement around said crankshaft;

a fluid displacement module (FDM) for quick and easy assembly with said housing and said crankpin, said FDM having a first piston/cylinder assembly comprising a single piece double-ended piston connected in assembly to said crankpin to operably provide said piston with a circular motion, said piston having a piston head on each end;

two cylinders, each cylinder having a cylinder head, each cylinder head having a side which in assembly encloses one end of an associated displacement chamber, each said cylinder for holding one end of said piston and one piston head, each said piston head in assembly encloses a second end of the associated displacement chamber;

each said cylinder head having a flat surface on a side opposite to the side enclosing the associated displacement chamber; and an opening in said cylinder head, said opening allowing fluid communication to and from the associated displacement chamber, said piston head having a protrusion sized to empty said opening at top dead center of piston travel;

two port plates each having a flat surface which in assembly is in sealing engagement with a mating flat surface of the associated cylinder head, each said port plate having two ports for fluid communication through said opening to the associated displacement chamber, one port being an inlet port to the displacement chamber and one port being an outlet port from the displacement chamber, in assembly said housing and each said port plate are held apart from direct mechanical contact by interposing pliable members to bear against said housing and each said port plate thereby allowing micromotion of each said port plate in two dimensions while allowing movement of each said port plate in one dimension to enable continuous direct sealing engagement between the flat surface of each said port plate with the mating flat surface of the associated cylinder head; and wherein in operation, the circular movement of said piston imparts a reciprocating movement to each said cylinder, the flat surface of the associated cylinder head moving back and forth across the flat surface of the associated port plate once per revolution of said crankpin wherein the associated opening is successively brought into fluid communication with the associated inlet port and outlet port.

2. The PFDD of claim 1 wherein the FDM further includes a second double-ended piston/cylinder assembly identical to said first piston/cylinder assembly thereby providing four pistons, four cylinders and four displacement chambers, said PFDD including additional port plates to interact with said second piston/cylinder assembly.

3. The PFDD of claim 2 wherein the first and second piston/cylinder assemblies nest together when assembled into said PFDD such that the axis of all pistons are in the same plane perpendicular to the axis of said crankshaft.

4. The PFDD of claim 3 further including a bearing mounted on said crankpin, in assembly said bearing fits into an opening in each said piston.

5. The PFDD of claim 4 further including grooves associated with said housing, rails for assembly into said grooves, in assembly said rails holding said cylinder head for sliding movement, the grooves/rails/cylinder head assembly locating the associated piston such that a four piston PFDD locates each piston at approximately 90° from its neighboring pistons.

6. The PFDD of claim 5 further including a resilient member located between said housing and each of said rails for urging the rail/cylinder head assembly together.

7. The PFDD of claim 5 wherein the said rails are comprised of lubricating material.

8. The PFDD of claim 1 wherein said pliable members include members on opposite sides of each said port plate interposed between said housing and said port plate to prevent direct mechanical contact of said housing and each said port plate.

9. The PFDD of claim 8 further including a manifold, said manifold having an inlet port and an outlet port for connection to an associated displacement chamber through the associated port plate, and wherein the said pliable members include a buffering member interposed between said housing and a third side of each said port plate to prevent direct mechanical contact of said housing and each said port plate, each said buffering member urging the associated port plate toward said manifold.

10. The PFDD of claim 9 further including, in assembly, a pliable seal between a fourth side of each said port plate and said manifold, said pliable seal preventing direct mechanical contact between each said port plate and said manifold.

11. The PFDD of claim 10 wherein said pliable members further include an urging member interposed between a fifth side of each said port plate and said housing, said fifth side opposite to the mating flat surface of each said port plate for urging the mating flat surface into said sealing engagement with the flat surface of the associated cylinder head, said urging member also acting to prevent direct mechanical contact between said housing and the associated port plate.

12. The PFDD of claim 11 wherein said urging member is a spring with a configuration which applies pressure in the center of the associated port plate.

13. The PFDD of claim 1 wherein the assembly of each cylinder and cylinder head includes clearance space between them to prevent the application of forces on the cylinder and cylinder head in a direction parallel to the axis of the cylinder.

14. The PFDD of claim 13 further including a resilient sealing member between each said cylinder and the associated cylinder head to apply sealing force between them in a direction perpendicular to the axis of cylinder.

15. The PFDD of claim 14 further including a cylinder carriage into which an associated cylinder is mounted and a compliant washer located between the cylinder and the cylinder carriage.

16. The PFDD of claim 15 wherein each said cylinder head is securely fastened to the associated cylinder carriage, each said carriage having an end with recesses cut therein to provide a plurality of small mounting surfaces for connection to the associated cylinder head.

17. The PFDD of claim 1 wherein each said piston head has a sealing lip integral therewith for sealing assembly with the associated cylinder.

18. The PFDD of claim 17 further including an elastomeric element located on each said piston head for urging said sealing lip into engagement with the associated cylinder.

19. The PFDD of claim 1 further including a manifold connected in assembly to said housing, said manifold having passageways for fluid to connect inlet and outlet ports in said manifold to corresponding inlet and outlet ports in each port plate, said manifold comprising two layers, a first layer having grooves on a flat surface thereof, said second layer having a flat surface for mating with the grooved flat surface of said first layer wherein said grooves are sealed to provide said passageways.

20. The PFDD of claim 1 wherein said driveshaft of a motor is directly coupled to said crankshaft.

21. The PFDD of claim 1 wherein said driveshaft of a motor is directly coupled to said crankshaft through a torque increaser.

22. The PFDD of claim 21 wherein said torque increaser includes a pinion mounted on said driveshaft and a ring gear mating in assembly with said pinion, said ring gear connected to said crankshaft.

23. A positive fluid displacement device (PFDD) for delivering a fluid comprising a housing for said device;

a crankshaft mounted within said housing, said crankshaft for coupling to the driveshaft of a motor;

a crankpin connected to said crankshaft to provide an orbital movement around said crankshaft;

a fluid displacement module (FDM) for quick and easy assembly with said housing and said crankpin, said FDM having a first piston/cylinder assembly comprising a piston connected in assembly to said crankpin to operably provide said piston with a circular motion, said piston having a piston head;

a cylinder having a cylinder head, said cylinder head having a side enclosing one end of a displacement chamber, said cylinder for holding said piston, said piston head enclosing a second end of said displacement chamber;

said cylinder head having a flat surface on a side opposite to the side enclosing said displacement chamber; and an opening in said cylinder head, said opening allowing fluid communication to and from said displacement chamber, said piston head having a protrusion sized to empty said opening of fluid at top dead center of piston travel;

a first port plate having a flat surface which in assembly is in sealing engagement with the flat surface of said cylinder head, said port plate having two ports for fluid communication through said opening to said displacement chamber, one port being an inlet port to said displacement chamber and one port being an outlet port from said displacement chamber, in assembly said housing and said port plate are held from direct mechanical contact therewith by interposing pliable members to bear against said housing and each said port plate thereby allowing micromotion of said port plate in two dimensions while allowing movement of said port plate to follow movement of the mating flat surface of the cylinder head; and wherein in operation, the circular movement of said crankpin imparts a reciprocating movement to said cylinder, the flat surface of said cylinder head moving back and forth across the flat surface of said port plate once per revolution of said crankpin wherein said opening is successively brought into fluid communication with said inlet port and said outlet port.

24. The PFDD of claim 23 wherein the assembly of each cylinder and cylinder head includes clearance space between them to prevent the application of forces on the cylinder and cylinder head in a direction parallel to the axis of the cylinder.

25. The PFDD of claim 24 further including a resilient sealing member between each said cylinder and the associated cylinder head to apply sealing force between them in a direction perpendicular to the axis of cylinder.

26. The PFDD of claim 25 further including a cylinder carriage into which an associated cylinder is mounted and a compliant washer located between the cylinder and the cylinder carriage.

27. A positive fluid displacement device (PFDD) for delivering a fluid comprising a housing for said device;

a crankshaft mounted within said housing, said crankshaft for coupling to the driveshaft of a motor;

a crankpin connected to said crankshaft to provide an orbital movement around said crankshaft;

a fluid displacement module (FDM) for quick and easy assembly with said housing and said crankpin, said FDM having a first piston/cylinder assembly comprising a piston having a piston head, said piston connected to said crankpin to operably provide said piston with a circular motion;

a cylinder having a cylinder head, said cylinder head having a side enclosing one end of a displacement chamber, said cylinder for holding said piston, said piston head enclosing a second end of said displacement chamber;

said cylinder head having a flat surface on a side opposite to the side enclosing said displacement chamber; and an opening in said cylinder head, said opening allowing fluid communication to and from said displacement chamber, said piston head having a protrusion sized to empty said opening of fluid at top dead center of piston travel;

a first port plate having a flat surface which in assembly is in sealing engagement with the flat surface of said cylinder head, said port plate having two ports for fluid communication through said opening to said displacement chamber, one port being an inlet port to said displacement chamber and one port being an outlet port from said displacement chamber, in assembly said housing holds said port plate from direct mechanical contact therewith by interposing pliable connections to bear against said housing and each said port plate thereby allowing micromotion of said port plate in two dimensions while allowing movement of said port plate with the mating flat surface of the cylinder head; and a manifold connected in assembly to said housing, said manifold having passageways for fluid to connect inlet and outlet ports in said manifold to corresponding inlet and outlet ports in each port plate, said manifold comprising two layers, a first layer having grooves on a flat surface thereof, said second layer having a flat surface for mating with the grooved flat surface of said first layer wherein said grooves are sealed to provide said passageways.

28. A method of eliminating valves and achieving near dead volume in a positive fluid displacement device (PFDD) employing pistons to draw fluid into a displacement chamber and expel fluid therefrom, and to eliminate internal leakage in said PFDD, said method comprising providing a PFDD housing with a crankshaft and a crankpin, said crankpin providing circular motion around said crankshaft;

providing a piston capable of being driven by said crankpin in a circular motion;

providing a cylinder, said cylinder having a cylinder head, said cylinders capable of being driven by said crankpin in a reciprocating motion;

providing an opening in said cylinder head for allowing fluid communication to and from the displacement chamber;

providing a protrusion on said piston, said protrusion sized to empty said opening when the piston is at top dead center to achieve near zero dead volume in the displacement chamber;

providing inlet and outlet ports for allowing alternating fluid communication through the opening to fill the displacement chamber on an intake stroke of the piston and to empty the displacement chamber on an exhaust stroke of the piston to achieve valveless operation;

providing a port plate containing said inlet and outlet ports, said port plate having a flat surface for mating with a flat surface on said cylinder head to provide a sealing relationship therebetween;

providing for a port plate mounting arrangement that allows said port plate to move in one dimension to maintain the sealing relationship with said cylinder head and to accommodate sufficient clearance of said cylinder head in two other dimensions to allow for movement in said one dimension wherein said port plate mounting arrangement includes providing for no direct mechanical contact between said port plate and said housing; and providing for the maintenance of sufficient force on said port plate in a dimension perpendicular to the plane of reciprocating motion to maintain said sealing relationship and thereby eliminate internal leakage in said PFDD.

29. The method of claim 28 wherein said mounting arrangement includes an urging member for applying force to the center of the port plate/cylinder head contacting surfaces.

30. The method of claim 28 wherein pliable members are interposed between all adjacent housing surfaces and surfaces of said port plate.

31. The method of claim 30 further including providing a manifold with passageways for connection to said inlet and outlet ports in said port plate and wherein said mounting arrangement further includes providing for no direct mechanical contact between said port plate and said manifold.

32. The method of claim 31 wherein said mounting arrangement includes providing a pliable buffering member to urge said port plate into sealing engagement with said manifold, and wherein said manifold/port plate interface includes providing for a pliable seal to prevent direct mechanical contact between said port plate and said manifold.

33. The method of claim 28 further including providing for a cylinder carriage to which said cylinder head is fastened to form a cylinder/head carriage assembly; and providing for holding said cylinder within said cylinder carriage such that a clearance space is provided between said cylinder and said cylinder head so that forces are not placed on said cylinder or said cylinder head in a direction parallel to the axis of said cylinder and said piston.

34. The method of claim 33 further including providing for a compliant sealing member between said cylinder and said cylinder head such that forces on said cylinder and said cylinder head are in a direction perpendicular to the axis of said cylinder and said piston.

35. The method of claim 33 further including providing compliant material between said cylinder and said carriage.

36. The method of claim 28 further including providing a cylinder carriage with an end to which said cylinder head is fastened to form a cylinder carriage/head assembly, said carriage including providing recesses in an end of said carriage such that a plurality of small surfaces contact said cylinder, said small surfaces provided to a flatness of better than two light bands; and providing a flat surface with a flatness of better than two light bands on said cylinder head for mating with said contact surfaces.

37. The method of claim 28 further including providing said piston with a piston head, said piston head having a sealing lip, said sealing lip integral with said piston head.

38. The method of claim 28 further including providing grooves in said housing for guiding reciprocating motion of said cylinder head, said grooves including a resilient member.

39. The method of claim 28 further including providing a two-layer manifold with passageways for connecting the inlet and outlet ports of said port plate to devices external to said PFDD, the first layer having a flat surface into which grooves are placed; and providing the second layer with a flat surface for mating with the flat surface of the first layer thereby enclosing the grooves and creating said passageways.

40. The method of claim 39 wherein the flat mating surfaces of the first and second layers are provided with a flatness of better than two light bands.

41. The method of claim 28 further including providing said piston with single piece construction with two piston heads on opposite ends thereof; and providing said piston with an opening for receiving said crankpin.

42. The method of claim 41 further including providing a second piston with single piece construction and two piston heads, said second piston identical to the first piston in configuration, the configuration enabling nesting the two pistons together such that the axis of both pistons and all four piston heads are located in a single plane perpendicular to the axis of said crankshaft.

43. The method of claim 42 wherein each piston head is associated with a cylinder head, said housing holding said cylinder heads such that each piston is located approximately 90° from neighboring pistons.

* * * * *